US009364697B2

(12) United States Patent
Petit et al.

(10) Patent No.: US 9,364,697 B2
(45) Date of Patent: Jun. 14, 2016

(54) FOAM-APPLYING NOZZLE

(71) Applicant: Akron Brass Company, Wooster, OH (US)

(72) Inventors: Kevin J. Petit, Wooster, OH (US); Ajit P. Singh, Medina, OH (US); Frederick Lewis, Slidell, LA (US)

(73) Assignee: Akron Brass Company, Wooster, OH (US)

( * ) Notice: Subject to any disclaimer, the term of this patent is extended or adjusted under 35 U.S.C. 154(b) by 243 days.

(21) Appl. No.: 14/032,636

(22) Filed: Sep. 20, 2013

(65) Prior Publication Data

US 2014/0084076 A1 Mar. 27, 2014

Related U.S. Application Data

(60) Provisional application No. 61/703,831, filed on Sep. 21, 2012.

(51) Int. Cl.
*B05B 9/01* (2006.01)
*A62C 31/12* (2006.01)

(52) U.S. Cl.
CPC ..... *A62C 31/12* (2013.01)

(58) Field of Classification Search
CPC ..... B05B 9/01; B05B 5/032; B05B 5/053; B05B 12/002; B05B 12/008; B05B 5/047; B05B 5/1683; B05B 7/1486; B05B 15/025; G05G 1/01; G05G 1/04
USPC ..... 239/526, 146, 147, 172, 398, 419, 423; 169/62, 67, 52, 54
See application file for complete search history.

(56) References Cited

U.S. PATENT DOCUMENTS

| | | | | |
|---|---|---|---|---|
| 2,183,561 | A | 12/1939 | Hamblin | |
| 4,186,772 | A | 2/1980 | Handleman | |
| 4,828,038 | A * | 5/1989 | Williams | A62C 31/12 169/14 |
| 5,012,979 | A * | 5/1991 | Williams | A62C 31/03 239/416.5 |
| 5,113,945 | A | 5/1992 | Cable | |
| 5,445,226 | A * | 8/1995 | Scott | B05B 7/0056 169/15 |
| 5,613,773 | A * | 3/1997 | Scott | A62C 31/12 169/44 |
| 5,779,158 | A * | 7/1998 | Baker | B05B 7/0018 169/15 |
| 5,906,316 | A * | 5/1999 | Gatzemeyer | B05B 1/3442 137/268 |
| 2002/0005439 | A1 | 1/2002 | Kendall | |
| 2003/0052191 | A1 * | 3/2003 | Saner | A62C 31/03 239/296 |
| 2010/0116512 | A1 | 5/2010 | Henry | |

OTHER PUBLICATIONS

International Search Report, Patent Cooperation Treaty Application No. PCT/US2013/060957, mailed Mar. 25, 2014.

* cited by examiner

*Primary Examiner* — Justin Jonaitis
(74) *Attorney, Agent, or Firm* — Brouse McDowell; Michael G. Craig; Heather M. Barnes

(57) ABSTRACT

A foam-applying nozzle including a generally hollow housing. An eductor disposed in the housing has a generally hollow body with a wall, the hollow of the body forming an eduction chamber. An eductor inlet and an opposing eductor outlet are in fluid communication with the eduction chamber. A plurality of jet inlets extend into the wall of the body, the jet inlets terminating in jet ports that are in fluid communication with the eduction chamber. The jet inlets are configured to receive a predetermined portion of a pressurized fluid, the portion exiting through the jet ports generally toward the eductor outlet, creating a vacuum in the eduction chamber. The vacuum is configured to draw a foam solution into the eductor inlet, the foam solution mixing with the aforementioned portion of pressurized fluid in the eduction chamber to form a foam mixture.

18 Claims, 5 Drawing Sheets

FOAM-APPLYING NOZZLE

CROSS-REFERENCE TO RELATED APPLICATIONS

This application claims priority to U.S. provisional application 61/703,831, filed Sep. 21, 2012, the entire contents of which are hereby incorporated by reference.

FIELD

The present invention relates generally to fluid-dispensing nozzles utilized in connection with fire-fighting equipment, in particular to nozzles adapted to mix and dispense foamed fluids.

BACKGROUND

In large fires water alone is often inadequate for extinguishing the fire. To overcome this, water and fire-extinguishing foam mixtures have been developed that provide enhanced fire extinguishing capability when compared to plain water. These fire extinguishing foams require specialized nozzles for mixing together water and a foam solution for maximum effect.

A foam-applying nozzle typically utilizes a mixing eductor having a generally hollow body with an input opening and an opposing, spaced-apart output opening. A pressurized jet of water is directed into the input opening, creating a low-pressure area at the input opening that acts to draw a foam solution, which is coupled to the body, into the input opening. The foam solution mixes with the water jet in the body of the eductor, the mixed foam-water solution being ejected out of the output opening by the pressure of the water jet.

With reference to FIG. 1, a typical prior art foam-applying nozzle 10 utilizes a tubular constricting member 12 to create a single pressurized water jet 14 from a portion of a not-shown pressurized water supply that is coupled to an input opening 16. Water jet 14 creates a vacuum 18 in an eduction chamber 20 located downstream of input opening 16. The vacuum 18 draws a foam solution or concentrate 22 through a foam inlet 24 and into eduction chamber 20, where it mixes with water jet 14 to form a foam mixture 26. The foam mixture 26 exits nozzle 10 at an output opening 28 where it combines with the remaining portion of the water supply coupled to input opening 16, the remaining portion of the pressurized water supply having passed from the input opening to the output opening.

A drawback of this arrangement is that a single water jet 14 does not consistently evacuate air from eduction chamber 20. As a result, air 30 can enter into eduction chamber 20 faster than the single water jet 14 can evacuate it, particularly when the foam-applying nozzle 10 is adjusted for certain settings, such as a wide "fog-spray" setting. Air 30 thus limits the flow rate of the foam-applying nozzle 10. In this state the foam solution is not consistently drawn into the eduction chamber 20 and mixed with the water jet 14.

What is needed is a foam-applying nozzle that consistently draws foam solution to generate a consistent foam mixture, over a range of nozzle settings.

SUMMARY

A foam-applying nozzle is disclosed according to an embodiment of the present invention. The nozzle includes an eductor having a plurality of water jets. The plurality of water jets ensures the creation of a vacuum that is relatively constant over a wide range of water pressures and nozzle spray settings. Consequently, the nozzle consistently draws foam solution to generate a consistent foam mixture over a range of nozzle settings The nozzle of the present invention also comprises a relatively few number of components, thus simplifying assembly.

One aspect of the present invention is a foam-applying nozzle that includes a generally hollow housing. An eductor disposed in the housing has a generally hollow body with a wall, the hollow of the body forming an eduction chamber. An eductor inlet and an opposing eductor outlet are in fluid communication with the eduction chamber. A plurality of jet inlets extend into the wall of the body, the jet inlets terminating in jet ports that are in fluid communication with the eduction chamber. The jet inlets are configured to receive a predetermined portion of a pressurized fluid, the portion exiting through the jet ports generally toward the eductor outlet, creating a vacuum in the eduction chamber. The vacuum is configured to draw a foam solution into the eductor inlet, the foam solution mixing with the aforementioned portion of pressurized fluid in the eduction chamber to form a foam mixture.

Another aspect of the present invention includes a foam-applying nozzle having a generally hollow housing with an input opening that is configured to receive pressurized fluid. A generally tubular fluid constricting member is disposed in the housing and is configured to receive pressurized fluid from the input opening. An eduction chamber is also disposed in the housing, the eduction chamber being configured to receive pressurized fluid from the fluid constricting member. A plurality of openings extend between the constricting member and the eduction chamber, the openings being configured to provide a plurality of jets.

BRIEF DESCRIPTION OF THE DRAWINGS

Further features of the inventive embodiments will become apparent to those skilled in the art to which the embodiments relate from reading the specification and claims with reference to the accompanying drawings, in which:

DETAILED DESCRIPTION

Figure 1:
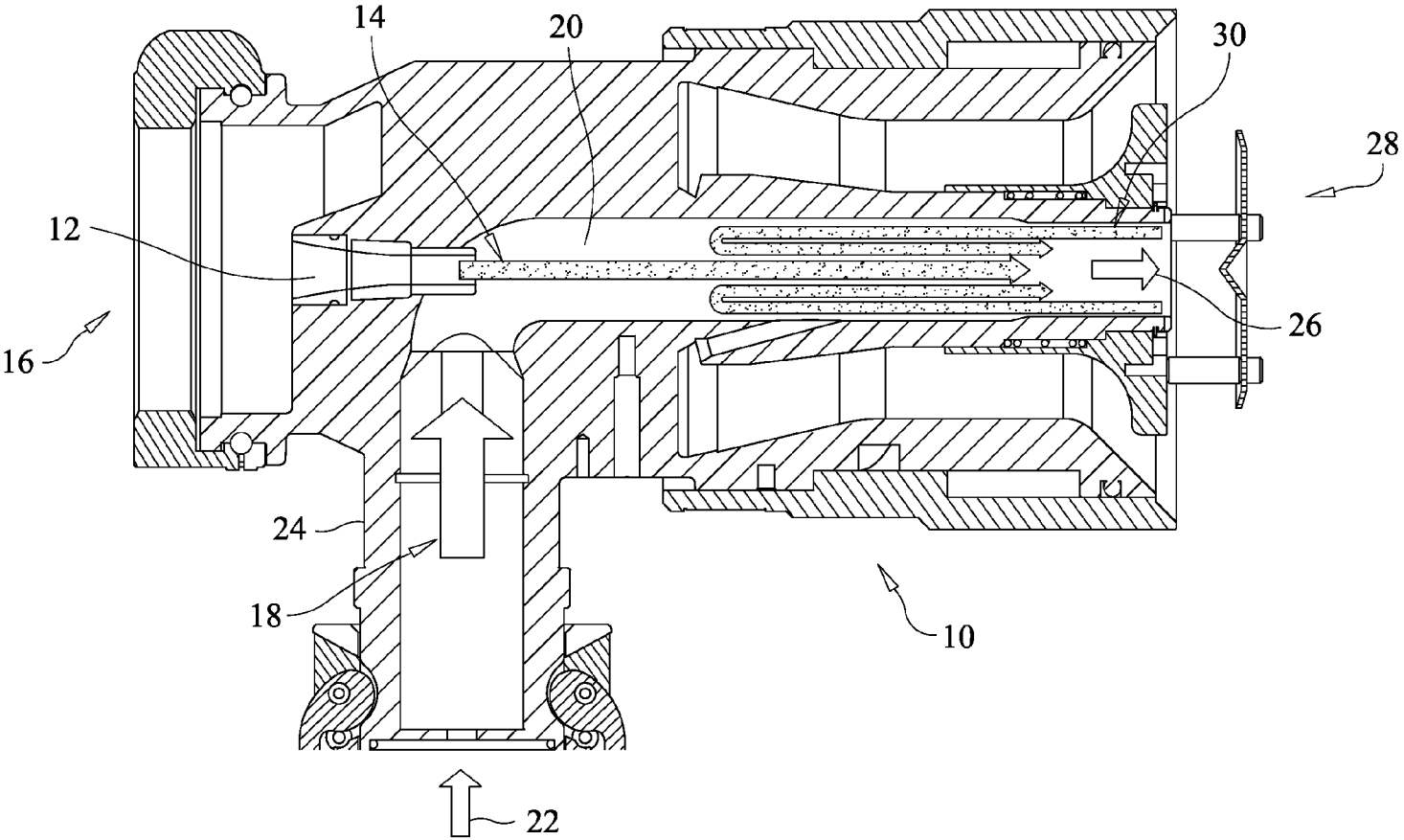
FIG. 1 PRIOR ART
FIG. 1 is a view in section of a prior art foam-applying nozzle.

In the discussion that follows, like reference numerals are used to refer to like elements and structures in the various figures.

Figure 2:
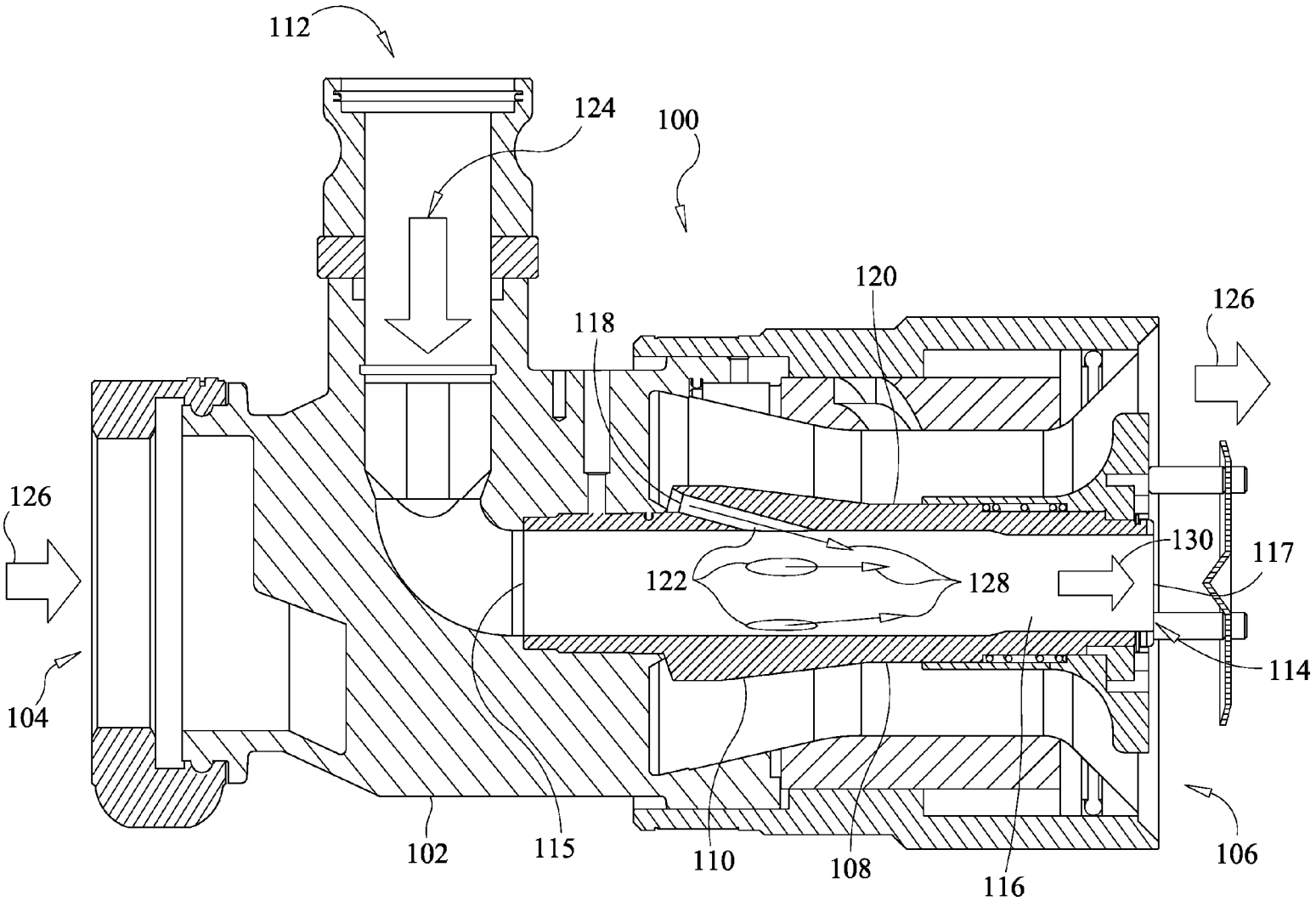
FIG. 2 is a view in section showing the general arrangement of a foam-applying nozzle according to an embodiment of the present invention.
Figure 3D:
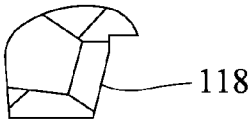
FIGS. 3A through 3D show details of an eductor of the foam-applying nozzle of FIG. 2.
Figure 3C:
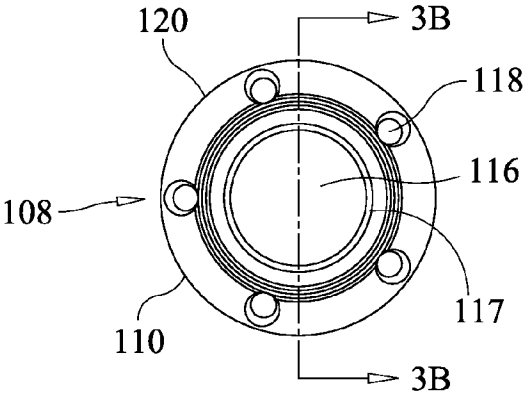
Figure 3A:
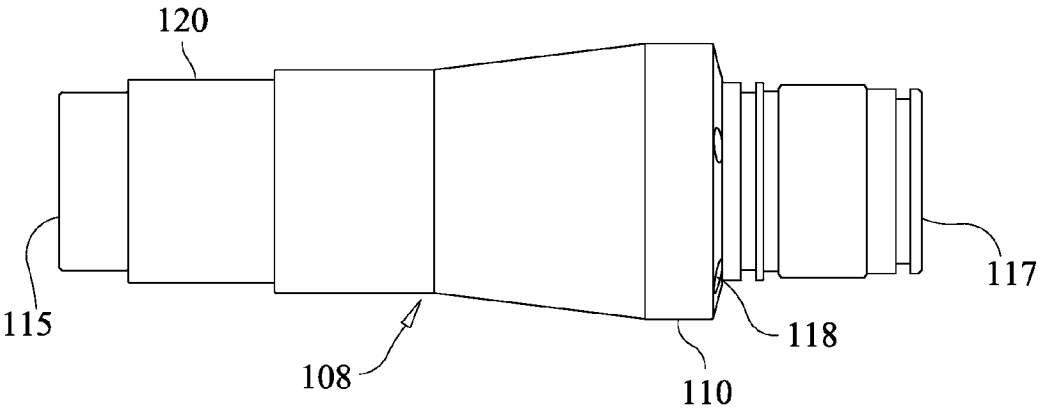
Figure 3B:
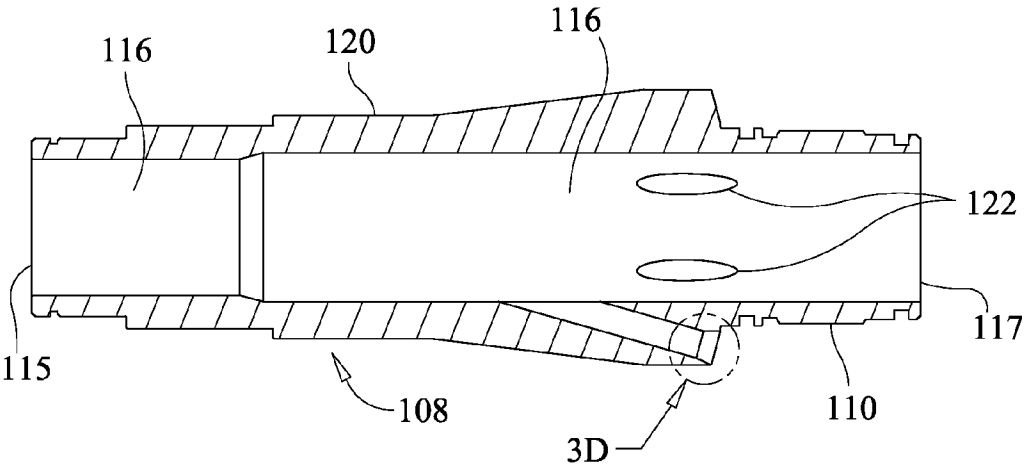

The general arrangement of a foam-applying nozzle 100 is shown in FIG. 2 according to an embodiment of the present invention. Foam-applying nozzle 100 comprises a generally hollow housing 102 having an input opening 104 and an opposing, spaced-apart output opening 106.

With reference to FIGS. 2, 3A, 3B, 3C and 3D together, housing 102 further includes an eductor 108 disposed in the hollow portion of the housing. Eductor 108 comprises a generally hollow body 110 coupled to a foam inlet 112 and a foam outlet 114. Eductor 108 further includes an eductor inlet 115, an eduction chamber 116, and an opposing eductor outlet 117, the eductor inlet and eductor outlet being in fluid communication with the eduction chamber. A plurality of water jet inlets 118 are formed in body 110, extending through a wall 120 of the body and terminating in water jet ports 122 that are in fluid communication with eduction chamber 116 and are generally directed toward eductor outlet 117.

With particular reference to FIG. 2, in operation of foam-applying nozzle 100 a supply of a foam solution 124, such as foam concentrate, is supplied to foam inlet 112. A pressurized fluid 126, such as water, is supplied to input opening 104 and exits the nozzle 100 at output opening 106. A portion of pressurized fluid 126 enters water jet inlets 118 of eductor 108 and exits through water jet ports 122, forming a plurality of pressurized water jets 128 in eduction chamber 116 that are directed generally toward foam outlet 114. Water jets 128 create a reduction in fluid pressure, hereafter generally referred to as a vacuum, in eduction chamber 116, causing foam solution 124 to be drawn into the eduction chamber through foam inlet 112 and eductor inlet 115 and mix with the water jets in the eduction chamber to form a foam mixture 130. Foam mixture 130 is expelled from eduction chamber 116 by the pressure of water jets 128, the foam mixture combining with the pressurized fluid 126 exiting eduction chamber outlet 117 and output opening 106.

Figure 4:
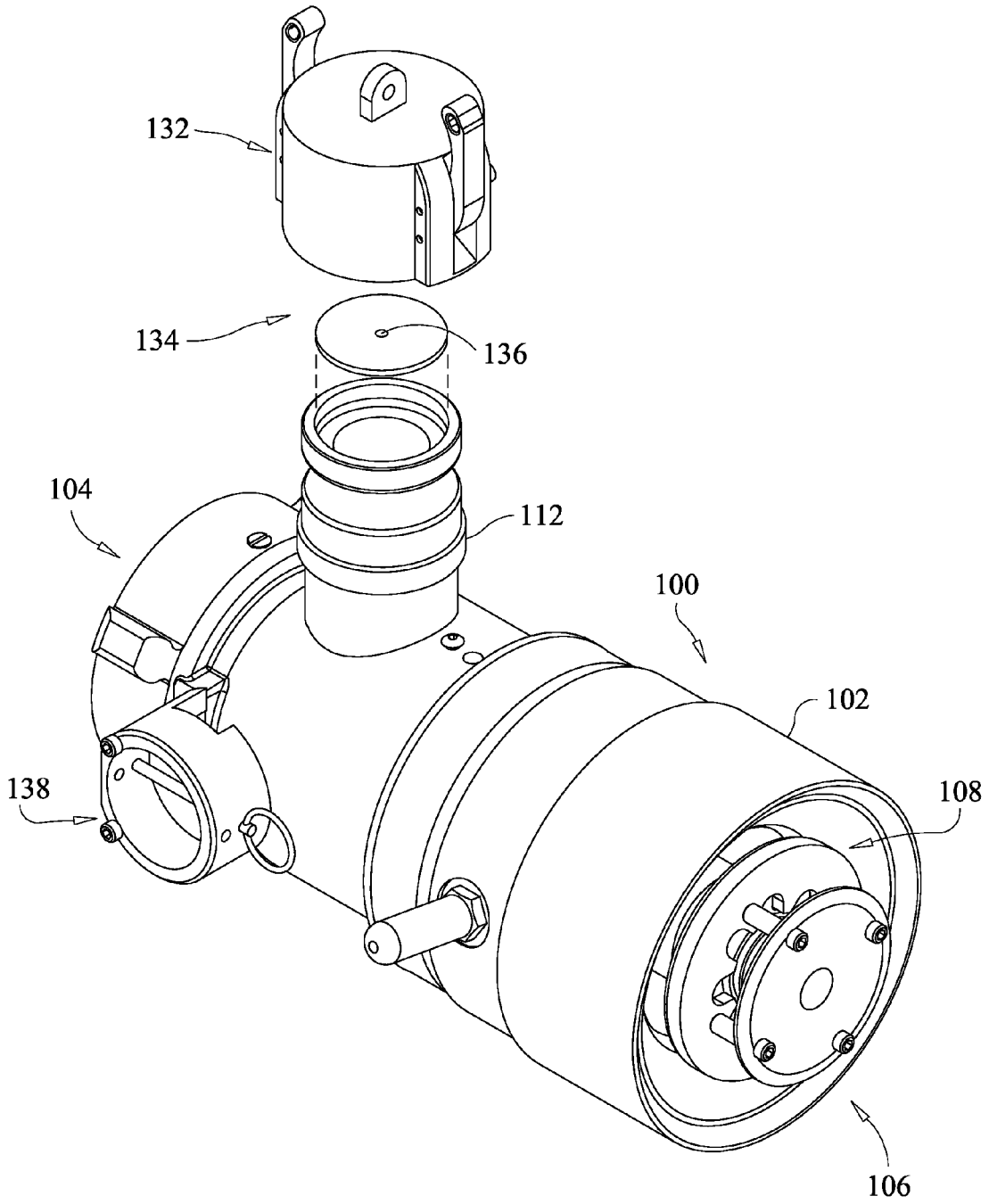
FIG. 4 shows additional features of the foam-applying nozzle of FIG. 2 according to several embodiments of the present invention.

FIG. 4 shows further details of foam-applying nozzle 100 according to several embodiments of the present invention. In one embodiment foam inlet 112 includes a removable cam-lock fitting 132 for coupling nozzle 100 to a not-shown supply for foam solution 124 (FIG. 2). Preferably, cam-lock fitting 132 is attachable to, and detachable from, housing 102 without the need for tools. A quick-change orifice element 134 having an appropriately-sized aperture 136 may be disposed in foam inlet 112 and retained by cam-lock fitting 132 to control or limit the quantity of foam solution 124 flowing into foam inlet 112. A plurality of orifice elements 134 having apertures 136 of differing sizes may be provided, and may optionally be stored with nozzle 100 in a storage receptacle 138 that is formed integral with or attached to housing 102.

Figure 5:
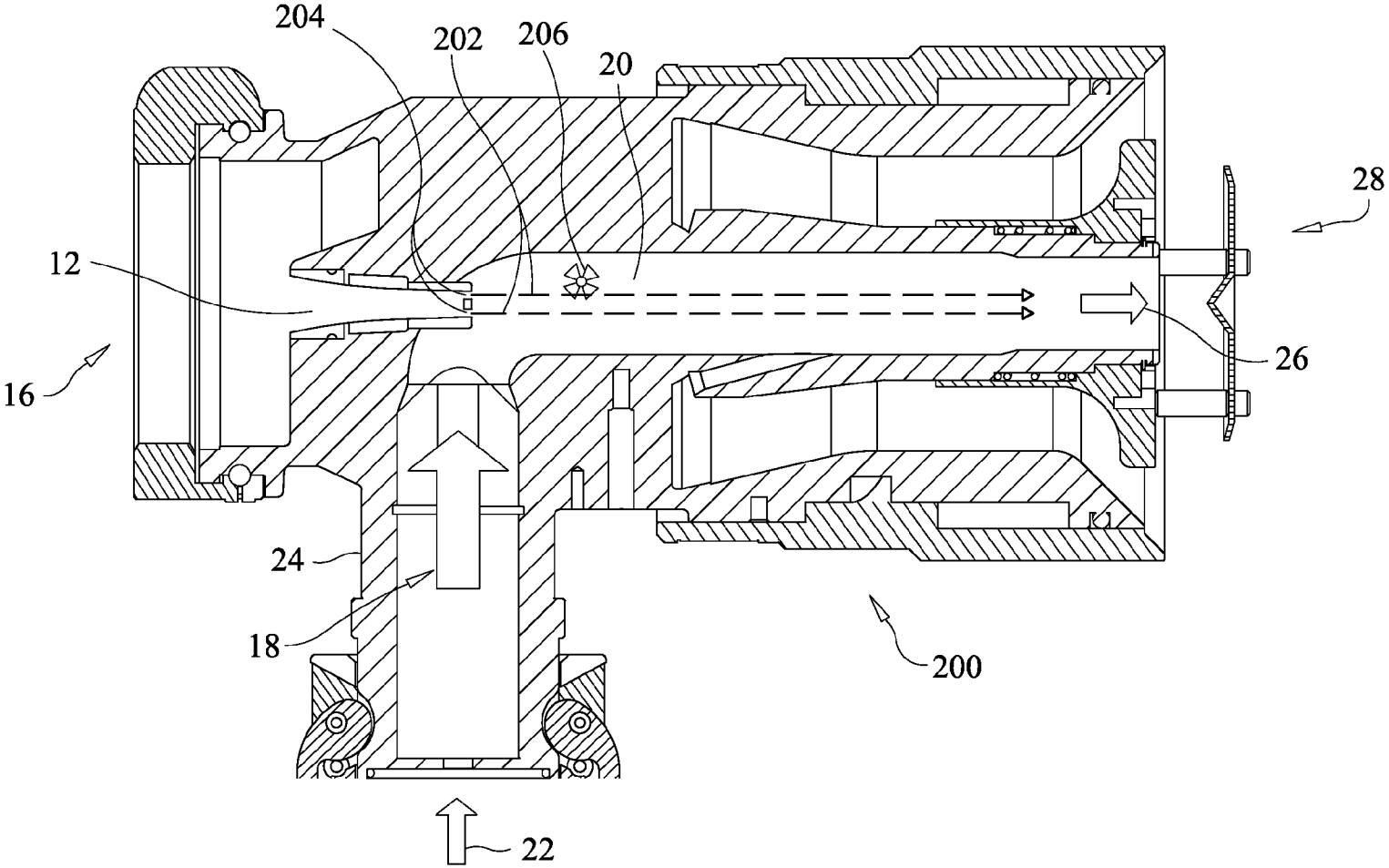
FIG. 5 shows the prior art foam-applying nozzle of FIG. 1 modified with improvements according to alternate embodiments of the present invention.

In other embodiments of the present invention the prior art nozzle of FIG. 1 may be retrofitted with the disclosed improvements. A nozzle 200 illustrating such modifications is shown in FIG. 5. In a first alternate embodiment constricting member 12 is reconfigured to provide a plurality of jets 202 by incorporating a plurality of openings 204 extending between the constricting member and eduction chamber 20. In a second alternative embodiment one or more mechanical agitators 206 are added to eduction chamber 20 to improve distribution and/or dispersion of water jet 14.

The disclosed invention provides a number of useful advantages over foam-applying nozzles in the art. Firstly, the disclosed nozzle has a relatively simple eductor design that provides consistent foam metering over a range of nozzle settings. In addition, the disclosed invention provides a way to quickly and easily change foam orifice elements 134 without the need for hand tools. Furthermore, the disclosed invention provides a way to store foam orifice elements 134 while they are not in use.

While this invention has been shown and described with respect to a detailed embodiment thereof, it will be understood by those skilled in the art that changes in form and detail thereof may be made without departing from the scope of the claims of the invention.

What is claimed is:

1. A foam-applying nozzle, comprising: a generally hollow housing; and an eductor disposed in the housing, the eductor comprising:

a generally hollow body having a wall, the hollow of the body forming an eduction chamber disposed centrally within the housing, an eductor inlet and an opposing eductor outlet, the eductor inlet and eductor outlet being in fluid communication with the eduction chamber, and a plurality of jet inlets terminating in jet ports directed into the eduction chamber, the jet inlets being-configured to receive a predetermined portion of a pressurized fluid, said portion of the pressurized fluid directed through the jet ports generally into the eduction chamber toward the eductor outlet, creating a vacuum in the eduction chamber, the vacuum in the eduction chamber resulting in a foam solution being drawn into the eductor inlet, the foam solution mixing with said portion of pressurized fluid in the eduction chamber to form a foam mixture.

2. The foam-applying nozzle of claim 1, further including:

a foam inlet having a removable fitting; and an orifice element disposed in the foam inlet, the orifice element being retained by the removable fitting, the orifice element further being quickly changeable.

3. The foam-applying nozzle of claim 2 wherein the orifice element further includes an aperture having a predetermined size.

4. The foam-applying nozzle of claim 2, further comprising a plurality of orifice elements provided therewith, the orifice elements each having an aperture, the apertures of the orifice elements being of differing sizes.

5. The foam-applying nozzle of claim 4 wherein the housing further includes a storage receptacle, the receptacle being configured to store the plurality of orifice elements.

6. The foam-applying nozzle of claim 2 wherein the removable fitting is a cam-lock fitting.

7. The foam-applying nozzle of claim 1 wherein the pressurized fluid exiting through the jet ports form pressurized jets.

8. The foam-applying nozzle of claim 7 wherein the foam mixture is expelled through the eductor outlet by the jets.

9. The foam-applying nozzle of claim 1 wherein the housing further includes an input opening and an opposing, spaced-apart output opening.

10. The foam-applying nozzle of claim 9 wherein:

the input opening is configured to receive the pressurized fluid; and the pressurized fluid and the foam mixture exit the output opening.

11. The foam-applying nozzle of claim 1 wherein the foam solution is a foam concentrate.

12. The foam-applying nozzle of claim 1 wherein the pressurized fluid is water.

13. A foam-applying nozzle, comprising:

a generally hollow housing;

a foam net having a removable cam-lock fitting;

an orifice element disposed in the foam inlet, the orifice element being retained by the removable fitting, the orifice element including an aperture having a predetermined size and further being quickly changeable; and an eductor disposed in the housing, the eductor including:

a generally hollow body having a wall, the hollow of the body forming an eduction chamber disposed centrally within the housing, an eductor inlet and an opposing eductor outlet, the eductor inlet and eductor outlet being in fluid communication with the eduction chamber, and a plurality of jet inlets terminating in jet ports in the eduction chamber, the jet inlets being configured to receive a predetermined portion of a pressurized fluid, said portion of the pressurized fluid exiting through the jet ports in the eduction chamber generally toward the eductor outlet, creating a vacuum in the eduction chamber, the vacuum in the eduction chamber being configured to draw a foam solution into the eductor inlet, the foam solution mixing with said portion of pressurized fluid in the eduction chamber to form a foam mixture.

14. The foam-applying nozzle of claim 13, further comprising a plurality of orifice elements provided therewith, the orifice elements each having an aperture, the apertures of the orifice elements being of differing sizes.

15. The foam-applying nozzle of claim 14 wherein the housing further includes a storage receptacle, the receptacle being configured to store the plurality of orifice elements.

16. A method for forming a foam mixture, comprising the steps of:

obtaining a generally hollow housing; and disposing an eductor in the housing, the eductor including:

a generally hollow body having a wall, the hollow of the body forming an eduction chamber disposed centrally within the housing, an eductor inlet and an opposing eductor outlet, the eductor inlet and eductor outlet being in fluid communication with the eduction chamber, and a plurality of jet inlets terminating in jet ports in the eduction chamber, configuring the jet inlets to receive a predetermined portion of a pressurized fluid, said portion of the pressurized fluid exiting through the jet ports into the eduction chamber, generally toward the eductor outlet, creating a vacuum in the eduction chamber, the vacuum in the eduction chamber being configured to draw a foam solution into the eductor inlet, the foam solution mixing with said portion of pressurized fluid in the eduction chamber to form a foam mixture.

17. The method of claim 16, further including the steps of:

obtaining a foam inlet having a removable fitting; and disposing an orifice element in the foam inlet, the orifice element being retained by the removable fitting, the orifice element further being quickly changeable.

18. The method of claim 16, wherein:

the pressurized fluid exiting through the jet ports form pressurized jets; and the foam mixture is expelled from the eduction chamber by the jets.

* * * * *